US005860397A

United States Patent [19]

Schafer

[11] Patent Number: 5,860,397

[45] Date of Patent: Jan. 19, 1999

[54] DEVICE FOR VARYING VALVE TIMING OF GAS EXCHANGE VALVES OF INTERNAL COMBUSTION ENGINE

[75] Inventor: Jens Schafer, Herzogenaurach, Germany

[73] Assignee: Ina Walzlager Schaeffler oHG, Germany

[21] Appl. No.: 93,603

[22] Filed: Jun. 9, 1998

[30] Foreign Application Priority Data

Jun. 21, 1997 [DE] Germany ..... 197 26 362.3

[51] Int. Cl.[6] ..... F01L 1/344

[52] U.S. Cl. ..... 123/90.17; 123/90.31; 123/90.37

[58] Field of Search ..... 123/90.15, 90.17, 123/90.31, 90.33, 90.34, 90.37; 74/568 R; 464/1, 2, 160, 161

[56] References Cited

U.S. PATENT DOCUMENTS

| | | | |
|---|---|---|---|
| 5,301,639 | 4/1994 | Satou | 123/90.17 |
| 5,309,873 | 5/1994 | Suga et al. | 123/90.17 |
| 5,509,384 | 4/1996 | Schmid | 123/90.17 |
| 5,666,914 | 9/1997 | Ushida et al. | 123/90.17 |
| 5,727,508 | 3/1998 | Goppelt | 123/90.37 |

FOREIGN PATENT DOCUMENTS

| | | | |
|---|---|---|---|
| 3942400 | 6/1991 | Germany . | |
| 4417959 | 11/1995 | Germany | 123/90.17 |

*Primary Examiner*—Weilun Lo

*Attorney, Agent, or Firm*—Bierman, Muserlian and Lucas

[57] ABSTRACT

A device (1) for varying the valve timing of the gas exchange valves of an internal combustion engine, essentially comprising a driven unit (2) rotationally fixed to an intake or exhaust camshaft, a drive unit (4) in driving relationship with a crankshaft through a traction element and formed by a drive pinion (5), a housing (6) and a pinion hub (10) made up of an inner ring (11) and an outer ring (13), the device (1) further comprising an adjusting piston (15) which is axially displaceable on the inner wall (7) of the housing (6) and axially delimits two pressure chambers (8, 9) while being connected to a hollow cylindrical sliding sleeve (18) to reduce pressure medium leakages between the pressure chambers (8, 9) and the noise produced by the adjusting piston (15) and the sliding sleeve (18) during their adjusting movements to a minimum by arranging between the outer surface (16) of the adjusting piston (15) and the inner wall (7) of the housing (6), and/or between the inner ring (11) of the pinion hub (10) and the sliding sleeve (18), an annular strip (21, 22) of a thermoplastic or of an elastomeric material which is configured both as a guide strip and a sealing ring for the adjusting piston (15), or for the sliding sleeve (18), as the case may be.

5 Claims, 2 Drawing Sheets

DEVICE FOR VARYING VALVE TIMING OF GAS EXCHANGE VALVES OF INTERNAL COMBUSTION ENGINE

FIELD OF THE INVENTION

A device for varying the valve timing of gas exchange valves of an internal combustion engine, comprising a shaft-like driven unit rotationally fixed to an intake or exhaust camshaft and having a helical gearing on one end, said device further comprising a drive unit which is in driving relationship with a crankshaft through a traction element, said drive unit comprising a drive pinion having a housing rotationally fixed thereon and a pinion hub having a coaxial inner ring surrounding the driven unit and a coaxial outer ring having a further helical gearing, the device also comprising an adjusting piston which is axially displaceable by a hydraulic pressure medium between two end positions and whose outer surface is guided on an inner wall of the housing, the adjusting piston axially delimiting two pressure chambers which can be connected alternately or simultaneously to a pressure medium feed duct and a pressure medium drain duct, said adjusting piston being made in one piece with a hollow cylindrical sliding sleeve which is movable between the inner ring and the outer ring of the pinion hub, said sliding sleeve comprising a first helical gear section and, axially spaced therefrom, an oppositely oriented, second helical gear section, the first helical gear section being complementary to and cooperating with the helical gearing of the driven unit and the second helical gear section being complementary to and cooperating with the helical gearing of the drive unit.

BACKGROUND OF THE INVENTION

In a device of the above type known from DE-OS 44 17 959, the piston surfaces of the adjusting piston likewise delimit two pressure chambers and the outer surface of the adjusting piston is likewise guided on the inner wall of the housing. To avoid an undesired transfer of the hydraulic pressure medium from one pressure chamber to the other, there is arranged on the outer surface of the adjusting piston, an annular groove in which a steel snap sealing ring is inserted which is slightly biased towards the inner wall of the housing.

A drawback of camshaft adjusting devices of the said type is that by the very presence of the split gap in the steel sealing ring, undesired transfers of the hydraulic pressure medium occur. Moreover, the inner wall of the housing has to be made with a high degree of precision, among other things, to exclude circularity errors which can lead to undesired pressure medium leakages between the pressure chambers. At the same time, due to the steel sealing ring, a high degree of wear is to be expected in the region of sealing and, as a result thereof, a continuously deteriorating sealing effect over the operational life of the device.

Another inherent drawback of camshaft adjusting devices with the aforesaid configuration are their disturbing noises during adjustment which are caused by free float phases and canting of the adjusting piston and sliding sleeve assembly and are transmitted to the housing of the device due to the steel sealing ring on the outer surface of the adjusting piston acting as a bridge for structure-borne noise. It is certainly possible to reduce these noises of adjustment by respecting closer tolerances of flank clearance in the manufacture of the helical gearings of the drive and driven units as well as of the helical gear sections of the sliding sleeve, but this leads to a considerable increase of the manufacturing costs of the device.

OBJECTS OF THE INVENTION

It is an object of the invention to create a device for varying the valve timing of gas exchange valves of an internal combustion engine in which the discussed drawbacks are eliminated and in which, particularly with the use of simple means, leakages between the pressure chambers of the device as well as adjusting noises emanating from the adjusting piston and sliding sleeve assembly are reduced to a minimum.

This and other objects and advantages of the invention will become obvious from the following detailed description.

SUMMARY OF THE INVENTION

The device of the invention for varying the valve timing of gas exchange valves of an internal combustion engine, comprising a shaft-like driven unit (2) rotationally fixed to an intake or exhaust camshaft and having a helical gearing (3) on one end, said device (1) further comprising a drive unit (4) which is in driving relationship with a crankshaft through a traction element, said drive unit (4) comprising a drive pinion (5) having a housing (6) rotationally fixed thereon and a pinion hub (10) having a coaxial inner ring (11) surrounding the driven unit (2) and a coaxial outer ring (13) having a further helical gearing (14), the device (1) also comprising an adjusting piston (15) which is axially displaceable by a hydraulic pressure medium between two end positions and whose outer surface (16) is guided on an inner wall (7) of the housing (6), the adjusting piston (15) axially delimiting two pressure chambers (8, 9) which can be connected alternately or simultaneously to a pressure medium feed duct and a pressure medium drain duct, said adjusting piston (15) being made in one piece with a hollow cylindrical sliding sleeve (18) which is movable between the inner ring (11) and the outer ring (13) of the pinion hub (10), said sliding sleeve (18) comprising a first helical gear section (19) and, axially spaced therefrom, an oppositely oriented, second helical gear section (20), the first helical gear section (19) being complementary to and cooperating with the helical gearing (3) of the driven unit (2) and the second helical gear section (20) being complementary to and cooperating with the helical gearing (14) of the drive unit (4), is characterized in that at least one of an annular strip (21) of a thermoplastic or elastomeric material configured both as a guide strip and a sealing ring for the adjusting piston (15) is arranged between the outer surface (16) of the adjusting piston (15) and the inner wall (7) of the housing (6), and an annular strip (22) of a thermoplastic or elastomeric material configured both as a guide strip and a sealing ring for the the sliding sleeve (18) is arranged between the inner ring (11) of the pinion hub (10) and the sliding sleeve (18).

The invention achieves the above objects in a device of the initially cited type for varying the valve timing of gas exchange valves of an internal combustion engine by arranging between the outer surface of the adjusting piston and the inner wall of the housing, and/or between the inner ring of the pinion hub and the sliding sleeve, an annular strip of a thermoplastic or of an elastomeric material which is configured both as a guide strip and a sealing ring for the adjusting piston, or for the sliding sleeve, as the case may be.

Thus, compared to the prior art, the camshaft adjusting device of the invention presents the advantage that by a defined friction force produced on the adjusting piston and the sliding sleeve by the elastic annular strips which act as guide strips for the adjusting piston and sliding sleeve, the hitherto occurring free float phases and canting of the adjusting piston and sliding sleeve assembly are effectively forestalled and therefore no longer constitute a source of noise excitation. At the same time, by the omission of the steel sealing ring on the outer surface of the adjusting piston, a potential structure-borne-noise bridge to the housing of the device is eliminated, so that the general noise level of a camshaft adjusting device of this configuration is markedly reduced.

Moreover, the camshaft adjusting device of the invention compares well with the state of the art due to the improved sealing between the pressure chambers and the resulting reduction of internal pressure medium leakages. Besides this, in comparison to a device in which a steel sealing ring is arranged on the outer surface of the adjusting piston, the device of the invention is much less prone to wear in the sealing region because a much more favorable friction pairing is obtained between the thermoplastic or elastomeric annular strips and the housing which is generally made of steel sheet. The invention further permits a saving of costs in the otherwise cost-intensive manufacturing of the helical gearings and helical gear sections of the drive and driven unit and the sliding sleeve because the elastic annular strips enable a widening of tolerances for the permissible flank clearance without negative consequences (adjusting noises) and thus enhance process reliability in the manufacturing of the gears.

A widening of the dimensional tolerance of the inner diameter of the sliding sleeve which is additionally permitted by the elastic annular strip on the outer surface of the adjusting piston can contribute to a further reduction of manufacturing costs of the device. However, by far the most economic embodiment of the invention is obtained if an elastic strip is arranged only between the adjusting piston and the inner wall of the housing because most of the aforesaid advantages can be obtained already with this one annular strip.

However, for avoiding adjusting noises, it is advantageous to arrange an annular strip both between the outer surface of the adjusting piston and the inner wall of the housing, and between the inner ring of the pinion hub and the sliding sleeve. In a first embodiment of the invention therefore, the elastic annular strip between the outer surface of the adjusting piston and the inner wall of the housing is arranged preferably in an annular groove in the outer surface of the adjusting piston, while in a second embodiment, the annular strip between the inner ring of the pinion hub and the sliding sleeve is arranged preferably in an annular groove in the inner ring of the pinion hub. These preferred arrangements of the annular strips have proved to be the most favorable with regard to manufacturing and material economy as well as with regard to the desired guiding and sealing efficiency. However, it is also possible in equivalent embodiments of the invention, to make the annular strips wider to correspond to the stroke of the piston and arrange them in annular grooves in the inner wall of the housing and in the inner wall of the sliding sleeve respectively, or to arrange only one of the two annular strips in one of said annular grooves.

According to a further feature of the invention, to obtain the desired good guiding and sealing properties, the annular strips are made preferably with a rectangular cross-sectional profile and bear with one of their wider peripheral surfaces against the bottom of the respective annular groove. The other wider peripheral surface of each annular strip then acts as a guide and sealing surface which slides along the inner wall of the housing, or along the inner wall of the sliding sleeve, as the case may be, during the travel of the adjusting piston and thus, due to its relatively large surface, prevents a canting and rattling of the adjusting piston. However, if proved in any way to be advantageous, the annular strips may also be made with other cross-sectional profiles, for example, with square, round, oval or similar sections. To improve the sliding properties of the annular strips, it is likewise possible to make them of mixed materials such as polytetrafluorethylene (Teflon) filled with bronze or carbon.

According to a final feature of the invention, the thickness of each annular strip is preferably slightly larger than the depth of its respective annular groove and, at the same time, the annular groove is slightly wider than the annular strip. While the latter feature facilitates the mounting of the annular strip in the annular groove, the advantage of a slightly thicker annular strip is that both when using only one strip or when using two strips at the same time, the elasticity of each of the strips can compensate any play between the housing, the adjusting piston with the sliding sleeve and the inner ring of the pinion hub while simultaneously producing a defined friction force of the annular strip which determines the guiding and sliding properties of the annular strip.

DETAILED DESCRIPTION OF THE DRAWINGS

Figure 1:
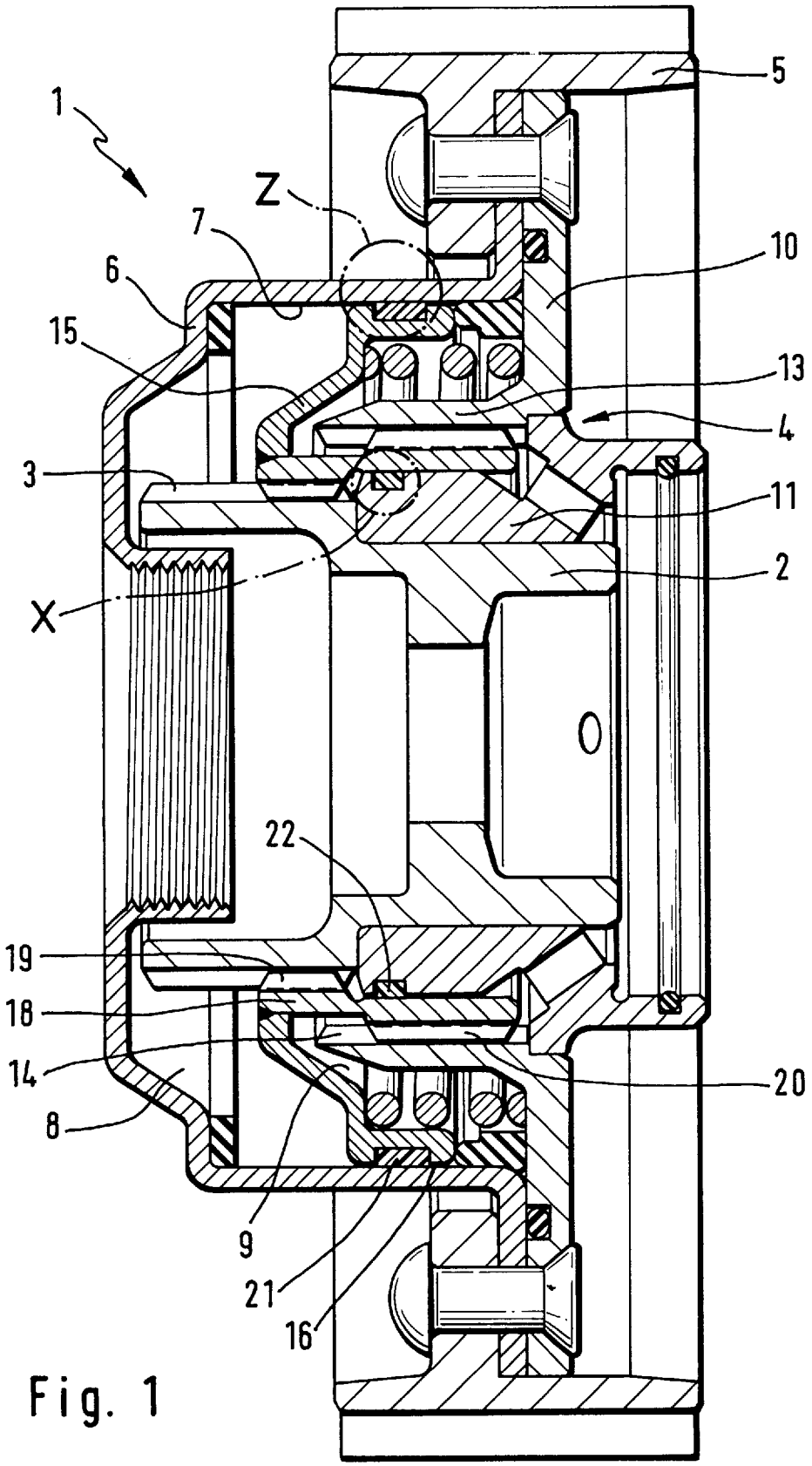
FIG. 1 is a longitudinal cross-section through a device of the invention for varying valve timing.

FIG. 1 shows a device 1 of a known type with which a continuous variation of the angular position of an intake or exhaust camshaft, not shown, relative to a crankshaft, not shown either, can be effected. The device 1 comprises a shaft-like driven unit 2 which is rotationally fixed to the camshaft and comprises a helical gearing 3 on one end. The device 1 further comprises a drive unit 4 which is in driving relationship with the crankshaft through a traction element and comprises a drive pinion 5 having a housing 6 rotationally fixed thereon and a pinion hub 10 having a coaxial inner ring 11 surrounding the driven unit 2 and a coaxial outer ring 13 with a further helical gearing 14.

FIG. 1 further shows that an outer surface 16 of an adjusting piston 15, which is axially displaceable by a hydraulic medium between two end positions and axially delimits two pressure chambers 8, 9 which can be connected alternately or simultaneously to a pressure medium feed duct and a pressure medium drain duct, is guided on the inner wall 7 of the housing 6. It can also be seen from the figure that the adjusting piston 15 is made in one piece with a hollow cylindrical sleeve 18 which is movable between the inner ring 11 and the outer ring 13 of the pinion hub 10. The sliding sleeve 18 comprises a first helical gear section 19 and, axially spaced therefrom, an oppositely oriented, second helical gear section 20, the first helical gear section 19 cooperating with the complementary helical gearing 3 on the driven unit 2, while the second helical gear section 20 cooperates with the complementary helical gearing 14 on the drive unit 4.

Figure 2:
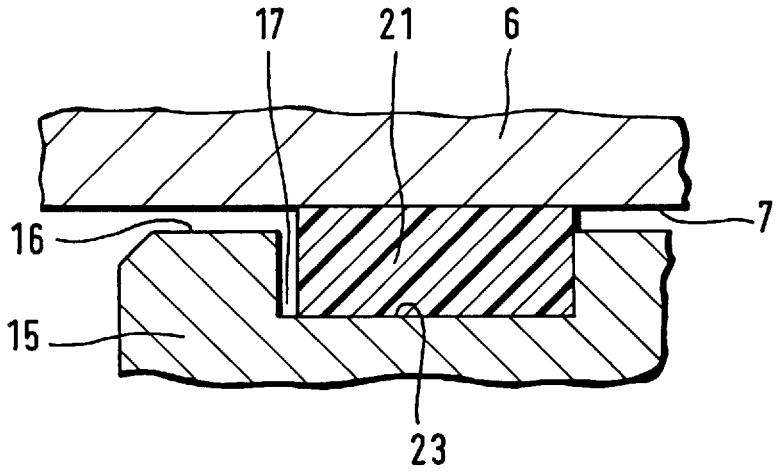
FIG. 2 is an enlarged representation of the detail "Z" of FIG. 1.
Figure 3:
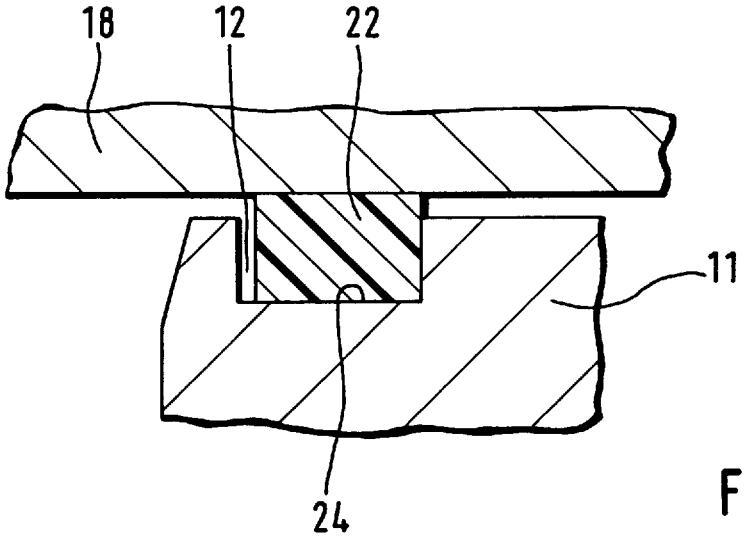
FIG. 3 is an enlarged representation of the detail "X" of FIG. 1.

The enlarged representations of the details "Z" and "X" in FIGS. 2 and 3 illustrate the main feature of the invention viz., an annular strip 21, 22 is arranged both between the outer surface 16 of the adjusting piston 15 and the inner wall 7 of the housing 6 and between the inner ring 11 of the pinion hub 10 and the sliding sleeve 18, and that said annular strips 21, 22 are configured both as guide strips and as sealing rings while being made in the instant case of a thermoplastic material. As can be seen in FIG. 2, the annular strip 21 between the outer surface 16 of the adjusting piston 15 and the inner wall 7 of the housing 6 is arranged in an annular groove 17 in the outer surface 16 of the adjusting piston 15. FIG. 3 shows that the annular strip 22 between the inner ring 11 of the pinion hub 10 and the sliding sleeve 18 is arranged in an annular groove 12 in the inner ring 11 of the pinion hub 10.

From FIGS. 2 and 3, it can be seen further that the annular strips 21, 22 have a rectangular cross-sectional profile and bear with one of their wider peripheral surfaces 23, 24 against the bottom of the respective annular groove 17, 12 and that the thickness of the annual strips 21, 22 is slightly larger than the depth of the respective grooves 17, 12. For facilitating mounting, the width of the annular grooves 17, 12 is slightly larger than that of the annular strips 21, 22. The other peripheral surfaces, not referenced, of the annular strips 21, 22 situated opposite the peripheral surfaces 23, 24 form the guiding and sealing surfaces for the adjusting piston 15 and the sliding sleeve 18 respectively.

Various modifications of the device of the invention may be made without departing from the spirit or scope thereof and it should be understood that the invention is intended to be limited only as defined in the appended claims.

What I claim is:

1. A device for varying the valve timing of gas exchange valves of an internal combustion engine, comprising a shaft-like driven unit (2) rotationally fixed to an intake or exhaust camshaft and having a helical gearing (3) on one end, said device (1) further comprising a drive unit (4) which is in driving relationship with a crankshaft through a traction element, said drive unit (4) comprising a drive pinion (5) having a housing (6) rotationally fixed thereon and a pinion hub (10) having a coaxial inner ring (11) surrounding the driven unit (2) and a coaxial outer ring (13) having a further helical gearing (14), the device (1) also comprising an adjusting piston (15) which is axially displaceable by a hydraulic pressure medium between two end positions and whose outer surface (16) is guided on an inner wall (7) of the housing (6), the adjusting piston (15) axially delimiting two pressure chambers (8, 9) which can be connected alternately or simultaneously to a pressure medium feed duct and a pressure medium drain duct, said adjusting piston (15) being made in one piece with a hollow cylindrical sliding sleeve (18) which is movable between the inner ring (11) and the outer ring (13) of the pinion hub (10), said sliding sleeve (18) comprising a first helical gear section (19) and, axially spaced therefrom, an oppositely oriented, second helical gear section (20), the first helical gear section (19) being complementary to and cooperating with the helical gearing (3) of the driven unit (2) and the second helical gear section (20) being complementary to and cooperating with the helical gearing (14) of the drive unit (4), characterized in that at least one of an annular strip (21) of a thermoplastic or elastomeric material configured both as a guide strip and a sealing ring for the adjusting piston (15) is arranged between the outer surface (16) of the adjusting piston (15) and the inner wall (7) of the housing (6), and an annular strip (22) of a thermoplastic or elastomeric material configured both as a guide strip and a sealing ring for the the sliding sleeve (18) is arranged between the inner ring (11) of the pinion hub (10) and the sliding sleeve (18).

2. A device of claim 1 wherein the annular strip (21) arranged between the outer surface (16) of the adjusting piston (15) and inner wall (7) of the housing (6) is disposed in an annular groove (17) in the outer surface (16) of the adjusting piston (15).

3. A device of claim 1 wherein the annular strip (22) arranged between the inner ring (11) of the pinion hub (10) and the sliding sleeve (18) is disposed in an annular groove (12) in the inner ring (11) of the pinion hub (10).

4. A device of claim 1 wherein each of the annular strips (21, 22) has a rectangular cross-sectional profile and bears with a wider peripheral surface (23, 24) against a bottom of the annular groove (17, 12) in which it is disposed.

5. A device of claim 1 wherein each of the annular strips (21, 22) has a thickness which is slightly larger than a depth of the annular groove (17, 12) in which it is disposed, and each annular groove (17, 12) is slightly wider that the annular strip (21, 22) disposed therein.

* * * * *